United States Patent [19]

Miller

[11] 4,105,276

[45] Aug. 8, 1978

[54] LAMPHOLDER-SOCKET FOR CIRCLINE FLUORESCENT LAMP

[75] Inventor: Jack V. Miller, Sierra Madre, Calif.

[73] Assignee: Killerwatt Corp., Los Angeles, Calif.

[21] Appl. No.: 770,752

[22] Filed: Feb. 22, 1977

[51] Int. Cl.[2] ..... H01R 9/08; H01R 33/02

[52] U.S. Cl. ..... 339/95 D; 339/50 C; 339/210 M

[58] Field of Search ..... 339/50 C, 95 D, 95 R, 339/198 R, 198 G, 198 GA, 198 H, 210 R, 210 M; 240/51.12

[56] References Cited

U.S. PATENT DOCUMENTS

| | | | |
|---|---|---|---|
| 2,713,668 | 7/1955 | Gibilisco | 339/95 D |
| 2,759,165 | 8/1956 | Batcheller | 339/258 S |
| 3,233,210 | 2/1966 | Knowles | 339/198 GA |
| 3,496,521 | 2/1970 | Hohorst | 339/95 D |
| 3,510,826 | 5/1970 | Soltan | 339/50 C |
| 3,569,911 | 3/1971 | Bogdanowicz | 339/95 D |
| 3,717,179 | 2/1973 | Clark | 339/210 R |

FOREIGN PATENT DOCUMENTS

| | | | |
|---|---|---|---|
| 1,412,437 | 11/1975 | United Kingdom | 339/95 D |

*Primary Examiner*—Neil Abrams
*Attorney, Agent, or Firm*—Christie, Parker & Hale

[57] ABSTRACT

A plurality of passages extend through an insulated body from one end to the other. Each passage has first and second sections separated by a protrusion forming a restriction in the passage. A conductive terminal is disposed in each passage. The terminal has a first channel with a U-shaped cross-section adapted to receive a circline lamp plug pin in the first section of the passage, a second channel with a U-shaped cross-section adapted to make a poke home connection with a wire in the second section of the passage, and a strip connecting the first and second channels across the restriction of the protrusion. The protrusions retain the terminals in their respective passages by limiting longitudinal movement of the sides of the channels. To make a poke home connection, the center of the second channel has a flap extending across the second section of the passage inclined in the direction of the first channel so a wire inserted in the second channel is wedged between the flap and the surface of the passage. Preferably, the housing is doglegged and the sections of the passage join at an obtuse angle matching the dogleg.

21 Claims, 4 Drawing Figures

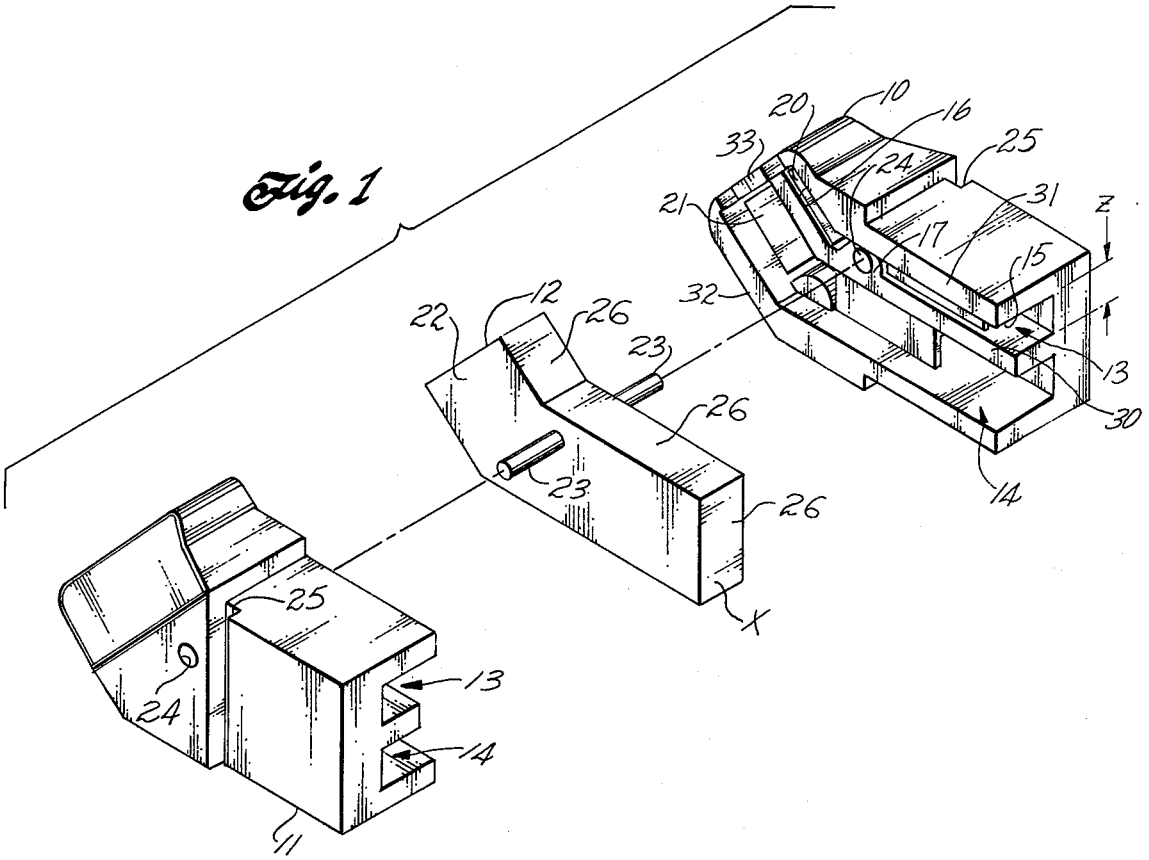
Fig. 1
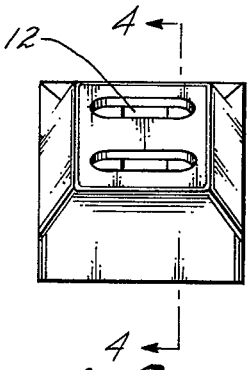
Fig. 3
Fig. 4
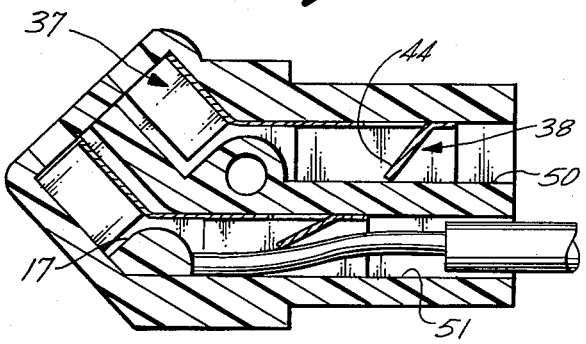

LAMPHOLDER-SOCKET FOR CIRCLINE FLUORESCENT LAMP

BACKGROUND OF THE INVENTION

This invention relates to electrical connectors and, more particularly, to a lampholder-socket for a circline fluorescent lamp.

A circline lamp is a ring-shaped fluorescent lighting device having a single plug and two electrodes located together in one region of the ring. The plug has four pins in a two by two arrangement inclined at an approximate angle of 45° to the plane of the lamp. The plug pins have some angular play to facilitate engagement with a lampholder-socket. Due to its efficient use of space, a circline lamp can be used in lighting fixtures designed for incandescent lamps, whereas the more conventional straight, elongated fluorescent lamp requires a specially designed fixture.

A fluorescent lighting device uses components, namely a ballast and a starter switch not required for an incandescent lamp. In the case of a circline lamp, these components are usually packaged in a housing located within the perimeter of the ring-shaped lamp. A lampholder-socket located outside the housing engages the plug pins of the circline lamp. Wires connect the lampholder-socket to the components within the housing. A plurality of supports located at spaced intervals around the housing hold the circline lamp in place. In one prior art design, the lampholder-socket is mounted in the suppport.

SUMMARY OF THE INVENTION

According to the invention, a lampholder-socket has a plurality of passages extending through an insulative body. A conductive terminal is disposed in each passage. At one end, the conductive terminal has a pin receiving channel adapted to make electrical contact with a plug pin inserted therein. At the other end, the terminal has a flap extending across the passage inclined in the direction of the pin receiving channel. The length of the flap is greater than the height of the passage, thereby preventing inclination of the flap away from the pin receiving channel. Thus, the flap is adapted to make a poke home connection with a wire inserted in the end of the passage. A protrusion retains each terminal in its respective passage.

In the preferred embodiment of the invention, the insulative body of the lampholder-socket is doglegged, the angle thereof matching the angle of inclination of the plug pins of the circline lamp. The passages each have first and second sections that join at an obtuse angle matching the dogleg of the body. The terminals are similarly doglegged, a strip between the channel and the flap being bent to form the dogleg of the terminals.

BRIEF DESCRIPTION OF THE DRAWING

The features of a specific embodiment of the best mode contemplated of carrying out the invention are illustrated in the drawing, in which:

FIG. 1 is an exploded perspective view of a lampholder-socket incorporating the principles of the invention;

FIG. 3 is an end view of the lampholder-socket of FIG. 1 after assembly; and FIG. 4 is a side-sectional view of the assembled lampholder-socket of FIG. 1 taken through the plane indicated in FIG. 3.

DETAILED DESCRIPTION OF THE SPECIFIC EMBODIMENT

Figure 2:
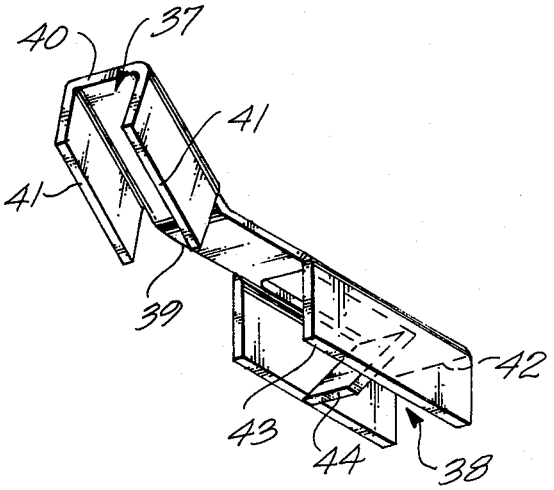
FIG. 2 is a perspective view of one of the terminals of the lampholder-socket of FIG. 1.

As illustrated in FIG. 1, a lampholder-socket for a circline fluorescent lamp has a three piece, doglegged, electrically insulative body comprising side pieces 10 and 11, which are mirror images of each other, and a center piece 12. Open channels 13 and 14 extend through each of side pieces 10 and 11 from end to end. As shown for channel 13, each passage has a section 15 and a section 16 that join at an obtuse angle, i.e., approximately 130° to 140°, matching the dogleg of the housing and a curved projection 17 near the junction of sections 15 and 16. Projection 17 extends across the passage to form a restriction in cross section along one side between sections 15 and 16. Electrically conductive terminals 20 and 21 are located in channels 13 and 14, respectively. Center piece 12 has flat side faces 22 (two in number) from which connecting rods 23 extend perpendicularly and flat end faces 26 (six in number) around the perimeter of side faces 22. Holes 24, which are dimensioned to receive connecting rods 23, extend through each of end pieces 10 and 11 from side to side transverse to and between channels 13 and 14. The length of connecting rods 23 is less than the length of holes 24. A groove 25, which is transverse to channels 13 and 14 on the outer side of each of end pieces 10 and 11, receives a U-shaped spring clip to mount the lampholder-socket to a panel. As shown for end piece 10, each end piece has between the length of channels 13 and 14 a partition with a surface 30 in the same plane as the flat ends of projections 17 of channels 13 and 14, a top wall having a surface 31, and a bottom wall having a surface 32, that lies in the same plane as surface 31. Each end piece also has between one end of channels 13 and 14 a partition with a surface 33 that lies in the same plane as surfaces 31 and 32. The width of the top and bottom walls is greater than the width of the partition between the length of channels 13 and 14; therefore surface 30 is recessed relative to surfaces 31, 32, and 33 an amount equal to one half the width of center piece 12, i.e. one half the distance between faces 22.

As illustrated in FIG. 2 terminals 20 and 21 each have in a one piece construction a channel 37 with a generally U-shaped cross-section, a channel 38 with a generally U-shaped cross-section, and a strip 39 connecting channels 37 and 38. Channel 37 has a center 40 and sides 41. Sides 41 are bent to converge slightly as shown in FIG. 2. As a result, when a plug pin of a circline lamp is inserted in channel 37, sides 41 are deflected somewhat outwardly to grip the pin tightly, holding it in place and establishing a good electrical contact therewith. Channel 38 has a center 42 and sides 43, which are not inwardly bent as are sides 41. In other words, sides 43 are approximately parallel to each other. A flap 44 is stamped out of center 42. Flap 44 is bent out of the plane of center 42 so it extends all the way or almost all the way across channel 38 inclined in the direction of channel 37. It is important that flap 44 be longer than the height of channels 13 and 14, designated Z in FIG. 1. Strip 39, which serves to electrically and mechanically connect channels 37 and 38, has a generally flat cross section to provide an easily bendable member for forming a dogleg in the terminal. Thus, channels 37 and 38 are each straight and strip 39 is bent to form the dogleg.

To assemble the body of the lampholder-socket, terminals 20 and 21 are placed in channels 13 and 14, respectively, as illustrated in FIG. 1, and rods 23 of center piece 12 are then completely inserted into holes 24 of end pieces 10 and 11. In such position, faces 22 of center piece 12 abut surfaces 30 and the flat end surfaces of projections 17. Faces 26 of center piece 12 abut the adjacent inner surfaces of end pieces 10 and 11, namely the inner surface of the partition perpendicular to surface 33, the inner surface of the top wall perpendicular to surface 31, and the inner surface of the bottom wall perpendicular to surface 32. Surfaces 31, 32, and 33 of end pieces 10 and 11 abut each other. Bonding material is placed between all these abutting surfaces and in holes 24 prior to assembly of side pieces 10 and 11 and center piece 12. The result is an integral body covering, separating and isolating four terminals in a two by two arrangement.

The assembled lampholder-socket is shown in FIGS. 3 and 4. As depicted by FIG. 4, face 22 of center piece 12 closes the open side of channels 13 and 14 to form individual, separate passages 50 and 51 through the body of the lampholder-socket. The partition and the top and bottom walls of each of end pieces 10 and 11 define a recess in which one-half of center piece 12 lies, so end pieces 10 surround all of center piece 12 except the end face 26 designated X in FIG. 1. Channel 37 of each terminal opens toward one end of the passage in position to receive the plug pins of the circline lamp. Channel 38 of each terminal opens toward the other end of the passage in a position to receive the stripped end of an insulated wire to be electrically connected to the plug pin to be received in channel 37. As the wire is inserted in channel 38, flap 44 makes a poke home connection. Specifically, prior to insertion of the wire, flap 44 extends across channel 38 to contact the partition between passages 50 and 51 while center 42 contacts the opposite side thereof, as illustrated in FIG. 4 by the terminal in passage 50. The wire inserted in channel 38 is wedged between flap 44 and the partition so it cannot be removed when a pulling force is exerted on the wire, as illustrated in FIG. 4 by the terminal in passage 51. Sides 43 serve to guide the wire into wedging engagement with flap 44. As shown in FIG. 4, protrusion 17 is in the path of the wire inserted into each passage (50 and 51). Protrusion 17 serves as a stop on the movement of the wire into the channel. To maximize the length of wire in the lampholder-socket, the wire is inserted until it abuts protrusion 17, as shown in FIG. 4. Due to the inclination of flap 44 toward channel 37, flap 44 bears harder and harder against the wire as the pulling force thereon is increased, thereby maintaining electrical contact and preventing removal of the wire. When the terminal is pulled or pushed as the plug pins are removed and engaged, the terminal is held substantially in place by projection 17, which serves as stops on the sides of channels 37 and 38. Reference is made to my application filed on even data herewith entitled, "Fluorescent Lampholder Assembly for Circline Lamp," Ser. No. 770,753 for one embodiment of the installation of the lampholder-socket described herein. This application is incorporated herein by reference. The spring clip disclosed therein fits in grooves 25 to mount the lampholder-socket to a panel through which it passes.

The described embodiment of the invention is only considered to be preferred and illustrative of the inventive concept; the scope of the invention is not to be restricted to such embodiment. Various and numerous other arangement may be devised by one skilled in the art without departing from the spirit and scope of this invention. For example, although a doglegged lampholder-socket is preferable because of the inclination of the plug pins of a circline lamp, the pinciples of the invention may have applicability to a lampholder-socket of a straight construction.

What is claimed is:

1. An electrical socket comprising:

an electrically insulative body doglegged at approximately between 130° and 140°;

a plurality of passages extending through the body from end to end, each passage having first and second sections that join at an obtuse angle between approximately 130° and 140°;

a conductive terminal disposed in each passage, the terminal having in a one piece construction a first channel-shaped portion adapted to receive a plug pin, a second portion having a flap extending across the passage inclined toward the first portion, and a third portion connecting the first and second portions, and the third portion of each terminal being bent to permit the first portion to lie in the first section of each passage and the second portion to lie in the second section of each passage, the flap being longer than the height of the passage so as to prevent inclination of the flap away from the first portion and so as to wedge a wire inserted in the second portion between the flap and the side of the passage, thereby electrically connecting and mechanically securing the inserted wire; and means for retaining the terminals in their respective passages.

2. The socket of claim 1, in which the first portion of each terminal has a generally U-shaped cross section formed by a center and two sides.

3. The socket of claim 2, in which the sides of the first portion are bent to converge slightly, thereby engaging plug pins inserted therein.

4. The socket of claim 3, in which the second portion has a U-shaped cross section formed by a center and two sides, the flap being formed at the center of the second portion and the sides of the second portion being approximately parallel to each other.

5. The socket of claim 1, in which the second portion has a U-shaped cross section formed by a center and two sides, the flap being formed at the center of the second portion and the sides of the second portion being approximately parallel to each other.

6. The socket of claim 1, in which the first portion of each terminal has a U-shaped cross section formed by a center and two sides, the second portion of each terminal has a U-shaped cross section formed by a center and two sides, the third portion of each terminal has a generally flat cross section connecting the centers of the first and second portions, and the retaining means comprises a protrusion from the electrically insulative body into each passage between the sides of the first and second channels in the region of the third portion to serve as stops on the sides of the first and second portions of the terminal and thereby to retain the terminal in the passage.

7. The socket of claim 1, in which the insulative body comprises:

a first side piece having a pair of channels open along one side and extending through the first side piece from end to end and having a hole extending transverse to the pair of channels;

a second side piece having a pair of channels open along one side and extending through the second side piece from end to end and having a hole extending transverse to the pair of channels; and a center piece having side faces adapted to close the open sides of the pairs of channels to form the passages when the first and second side pieces abut opposite sides of the center piece to form a partition between the respective pairs of channels of the first and second side piece having a pair of connecting rods extending transversely from the respective side faces of the center piece into the holes of the first and second end pieces, respectively, when first and second end pieces abut opposite sides of the center piece.

8. The socket of claim 7, in which the first and second side pieces are positioned to fit in abutment with opposite sides of the center piece, the body additionally comprising a bonding material lying between the side pieces and the center piece to form an integral socket body covering, separating, and isolating the conductive terminals.

9. The socket of claim 8, in which part of the bonding material lies in the holes to secure the connecting rods to the first and second side pieces.

10. An electrical socket comprising:

an electrically insulative body;

a plurality of passages extending through the body, each passage having first and second sections that join at an obtuse angle;

a conductive terminal disposed in each passage, the terminal having in a one piece construction a first channel with sides forming a generally U-shaped cross section adapted to receive a plug pin in the first section of the passage, a second channel with sides forming a generally U-shaped cross section, a center between the sides, the center having a flap extending across the second channel inclined toward the first channel, the flap being longer than the height of the passage so a wire inserted in the second channel is wedged between the flap and the passage to prevent inclination of the flap away from the first channel, thereby forming a poke-home connection, and a strip with a generally flat cross section connecting the first and second channels; and a protrusion from the electrically insulative body into each passage between the sides of the first and second channels in the region of the strip to serve as stops on the sides of the first and second channels and thereby to retain the terminal in the passage.

11. The socket of claim 10, in which the first and second sections of the passages are straight, the first and second channels of the conductive terminal are straight, and the strip of the conductive terminal is bent to form an angle matching the obtuse angle of the corresponding passage.

12. The socket of claim 11, in which the insulative body is dog legged and the obtuse angle matches the dog leg of the body.

13. The socket of claim 10, in which the protrusion lies in the path of the wire inserted in the second channel to serve as a stop on such inserted wire.

14. An electrical socket comprising:

a first side piece having a pair of channels open along one side and extending through the first side piece from end to end and having a hole extending transverse to the pair of channels;

a second side piece having a pair of channels open along one side and extending through the second side piece from end to end and having a hole extending transverse to the pair of channels;

a center piece having side faces adapted to close the open sides of the pairs of channels when the first and second side pieces abut opposite sides of the center piece to form a partition between the respective pairs of channels of the first and second side pieces, the center piece having a pair of connecting rods extending transversely from the respective side faces of the center piece into the holes of the first and second end pieces, respectively, when the first and second end pieces abut opposite sides of the center piece, the first and second side pieces being positioned to fit in abutment with opposite sides of the center piece, the side pieces each having a recess within which approximately one-half of the center piece lies so the side pieces surround the major portion of the center piece;

a conductive terminal disposed in each channel; and a bonding material lying between the side pieces and the center piece to form an integral socket body covering, separating, and isolating the conductive terminals.

15. The socket of claim 14, in which part of the bonding material lies in the holes to secure the connecting rods to the first and second side pieces.

16. The socket of claim 15, in which the holes of each side piece lie between the corresponding pair of channels.

17. The socket of claim 16, in which each conductive terminal comprises a first portion adapted to receive a plug pin, a second portion having a flap extending across the corresponding channel inclined toward the first portion, and a third portion connecting the first and second portions, the flap being longer than the width of the corresponding channel so as to prevent inclination of the flap away from the first portion and so as to wedge a wire inserted in the third portion between the flap and the side of the corresponding channel, thereby electrically connecting and mechanically securing the inserted wire, and means for retaining each terminal in the corresponding channel.

18. The socket of claim 17, in which the second portion has a U-shaped cross section formed by a center and two sides, the flap extending from the center of the second portion and contacting the opposite side of the corresponding channel.

19. The socket of claim 18, in which the first portion has a U-shaped cross section formed by a center and two sides, and the terminal retaining means comprises a protrusion from the corresponding side piece into the corresponding channel between the sides of the first and second portions of the terminal.

20. The socket of claim 16, in which each terminal has a first portion with sides forming a generally U-shaped cross section adapted to receive a plug pin, a second portion with sides forming a generally U-shaped cross section adapted to make a poke-home connection with a wire inserted therein, and a strip with a generally flat cross section connecting the first and second portions, the socket additionally comprising a protrusion from the corresponding side piece into the corresponding channel for each terminal, the protrusion lying between the first and second portions of the terminal in the region of the strip to serve as stops on the first and second portions and thereby to retain the terminal in the corresponding channel.

21. The socket of claim 14, in which the center piece has flat end faces around the perimeter of the side faces, and a portion of the bonding material lies between the flat end faces of the center piece and the side pieces.

* * * * *